United States Patent [19]

Williams

[11] 4,364,624

[45] Dec. 21, 1982

[54] ADAPTER ASSEMBLY FOR ELECTRICAL LEADS

[76] Inventor: Robert A. Williams, 55 Bounty Rd., E., Fort Worth, Tex. 76116

[21] Appl. No.: 896,390

[22] Filed: Apr. 14, 1978

[51] Int. Cl.[3] ..... H01R 11/00

[52] U.S. Cl. ..... 339/154 R; 174/87; 339/177 R

[58] Field of Search ..... 339/154 R, 154 A, 177 R; 174/82, 87, 74 R; 220/3, 8, 354, 352

[56] References Cited

U.S. PATENT DOCUMENTS

| | | | |
|---|---|---|---|
| 1,132,087 | 3/1915 | Hall | 220/352 X |
| 1,348,317 | 8/1920 | Randall | 220/352 |
| 2,755,331 | 7/1956 | Melcher | 339/177 R X |
| 2,813,144 | 11/1957 | Valach | 339/177 R X |
| 3,047,828 | 7/1962 | Gregson et al. | 339/177 R X |
| 3,432,612 | 3/1969 | Spiegel et al. | 174/87 X |
| 3,432,798 | 3/1969 | Brishka | 339/177 R X |

FOREIGN PATENT DOCUMENTS

| | | | |
|---|---|---|---|
| 1157274 | 5/1958 | France | 339/177 E |
| 920725 | 3/1963 | United Kingdom | 339/177 R |

*Primary Examiner*—William R. Briggs
*Attorney, Agent, or Firm*—Arthur F. Zobal

[57] ABSTRACT

An adapter assembly for electrical connectors is disclosed. The adapter assembly comprises a body with a T-shaped opening therein and male and female terminals positioned at right angle. An access opening with a press fitted closure is provided.

2 Claims, 4 Drawing Figures

FIG. 1
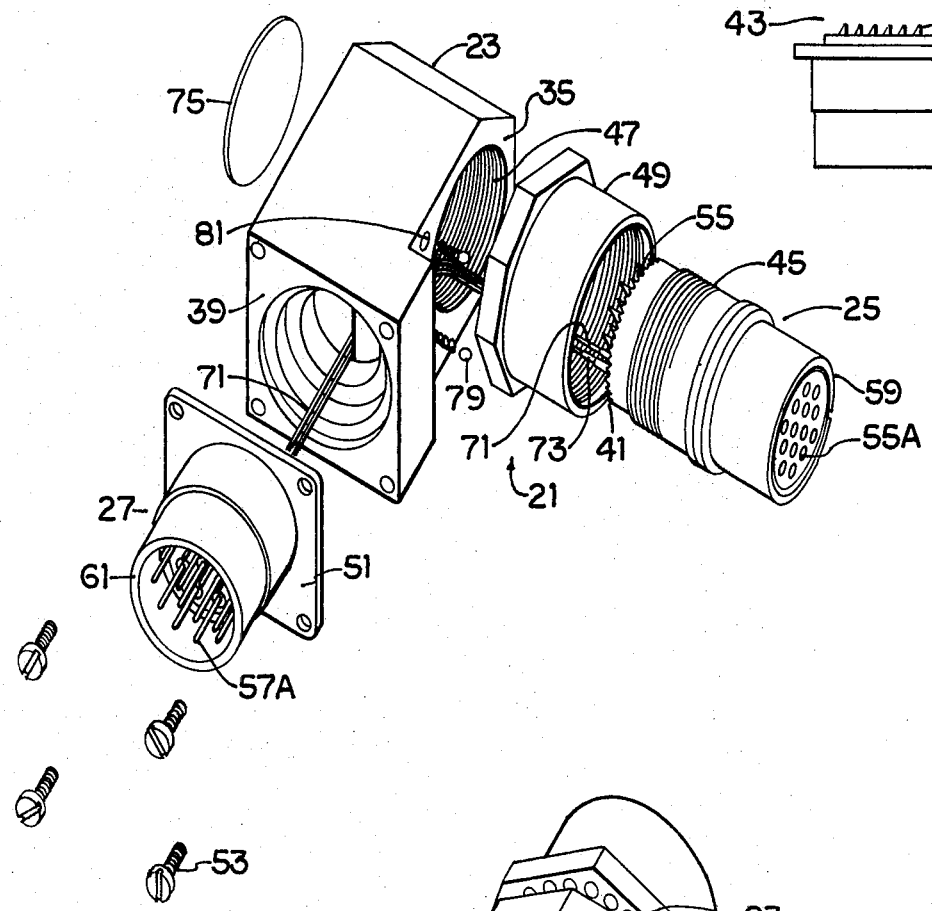
FIG. 4
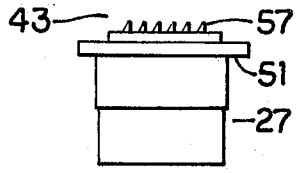
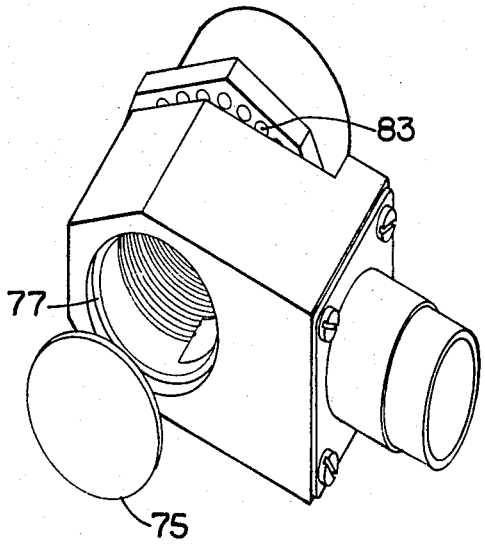
FIG. 2
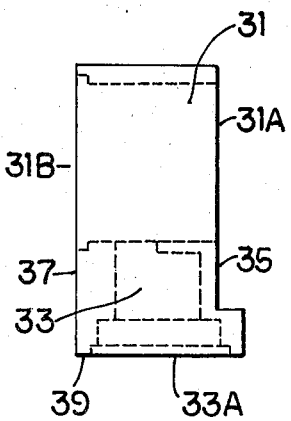
FIG. 3

ADAPTER ASSEMBLY FOR ELECTRICAL LEADS

BACKGROUND OF THE INVENTION

Field of the Invention:

This invention relates to an adapter for routing electrical leads.

SUMMARY OF THE INVENTION

It is an object of the present invention to provide an adapter to allow routing of electrical leads between connectors in a minimum of space.

It is a further object of the present invention to provide such an adapter which can be opened to allow routing and connections of the leads and which then can be closed with a press fitting closure member to provide protection and shielding of the leads and connectors.

BRIEF DESCRIPTION OF THE DRAWINGS

FIG. 1 is an exploded view of the adapter assembly of the present invention;

FIG. 2 is a rear view of the assembly of FIG. 1;

FIG. 3 is a side view of the adapter body of the assembly of FIGS. 1 and 2; and FIG. 4 is a side view of one of the electrical connectors of the assembly of FIGS. 1 and 2.

DESCRIPTION OF THE PREFERRED EMBODIMENT

Referring now to the drawings, reference numeral 21 identifies the adapter assembly which comprises an adapter body 23 and two electrical connectors 25 and 27. As seen in FIG. 3, the body 23 has a T-shaped opening extending therethrough and which is formed by two intersecting openings 31 and 33. Opening 31 extends through the body 23 from its side 35 to its opposite side 37 while opening 33 extends from side 39 into the body 23 and intersects opening 31.

The end 41 of connector 25 is coupled to the end 31A of opening 33 while the end 43 of connector 27 is coupled to the end 33A of opening 33 to form an L-shaped assembly. In this respect, connector 25 has male threads 45 formed around its periphery near its end 41 while the opening 31 has female threads 47 formed at its end 31A. Connector 25 is inserted through a nut 49 and its threads 45 threaded to threads 47. Connector 27 has a flange 51 which is secured to side 39 of the body by way of bolts 53 thereby securing the connector end 43 in communication with the end 33A of the opening 33.

Both of connectors 25 and 27 have a plurality of electrical terminals 55 and 57 at their inner ends 41 and 43, respectively. Terminals 55 are male terminals which extend through the connector 25 and terminate in female terminals 55A at the outer end 59 of the connector. Terminals 57 also are male terminals which extend through connector 27 and terminate in male terminals 57A at the outer end 61 of the connector.

Terminals 55 are connected to terminals 57 by way of electrical wires or leads 71 which are routed from connector 25 to connector 27 through the openings 31, 33 extending from side 35 to side 39. The leads 71 have female connectors 73 for connecting the leads to terminals 55 and 57.

The end 31B of opening 31 is employed to facilitate connection and routing of the leads 71 from terminals 55 to terminals 57. Connection and routing may be done prior to the attachment of the connector 27 to the side 39 of the body 23. After the leads 71 have been properly connected and routed, the circular end 31B of opening 31 is closed by press fitting a circular closure member 75 into the end 31B of opening 31 until it seats against shoulder 77. When press-fitted in place, the closure member 75 will completely seal the end 31B of opening 31.

Thus, as can be understood the adapter assembly allows routing of electrical leads in a minimum of space and provides hermetic and water proof sealing and EMI and RF1 shielding. These features are important in industries such as the air craft industry.

In one embodiment, the body 23, the exterior shell of the connectors 25 and 27, the nut 49, and the closure member 75 may be made of aluminum alloy. Members 79 are small metal balls which fit in apertures 81 and cooperate with indentions 83 of nut 49 to allow rotation of the nut.

What is claimed is:

1. An adapter assembly comprising:

a body formed of metal, a first opening extending through said body in a first direction, said first opening having first and second ends on opposite sides of said body, a second opening extending into said body in a second direction transverse to said first direction and intersecting said first opening, first electrical connector means having a plurality of electrical terminals at one end adapted to be coupled to said first end of said first opening of said body, second electrical connector means having a plurality of electrical terminals at one end adapted to be coupled to said second opening, a plurality of electrical leads adapted to be coupled to said electrical terminals of said first and second electrical connectors and routed between said electrical terminals of said first and second electrical connectors through the passageway formed by said first and second openings, said second end of said first opening being employed to facilitate connection and routing of said electrical leads to said terminals of said first and second electrical connectors, and a metallic closure member adapted to be press fitted in said second end of said first opening for closing said second end of said first opening.

2. An adapter assembly comprising:

a body formed of metal, a first opening extending through said body in a first direction, said first opening having first and second ends on opposite sides of said body, a second opening extending into said body in a second direction transverse to said first direction intersecting said first opening, first electrical connector means having a plurality of electrical terminals at one end coupled to said first end of said first opening of said body, second electrical connector means having a plurality of electrical terminals at one end coupled to said second opening, a plurality of electrical leads coupled to said electrical terminals of said first and second electrical connectors and routed between said electrical terminals of said first and second electrical connectors through the passageway formed by said first and second openings, said second end of said first opening being employed to facilitate connection and routing of said electrical leads to said terminals of said first and second electrical connectors, and a metallic closure member press fitted in said second end of said first opening closing said second end of said first opening, said closure member closing said second end of said first opening by a press fit only.

* * * * *